US011497286B2

(12) United States Patent
Parr et al.

(10) Patent No.: US 11,497,286 B2
(45) Date of Patent: Nov. 15, 2022

(54) JEWELRY HOLDER

(71) Applicant: Kellogg Wives Club, L.L.C., Chicago, IL (US)

(72) Inventors: Jessica Rachel Parr, Chicago, IL (US); Niki Leah Cordell, Chicago, IL (US); Molly Elizabeth Rymarz, Chicago, IL (US); Jessie Fazio Kochalski, San Francisco, CA (US)

(73) Assignee: 1276046 Ontario Inc., Toronto (CA)

( * ) Notice: Subject to any disclaimer, the term of this patent is extended or adjusted under 35 U.S.C. 154(b) by 0 days.

(21) Appl. No.: 15/710,634

(22) Filed: Sep. 20, 2017

(65) Prior Publication Data

US 2018/0084879 A1 Mar. 29, 2018

Related U.S. Application Data

(60) Provisional application No. 62/400,794, filed on Sep. 28, 2016.

(51) Int. Cl.

| | |
|---|---|
| ***A45C 1/04*** | (2006.01) |
| ***A45F 5/00*** | (2006.01) |
| ***A45C 13/02*** | (2006.01) |
| ***A45C 11/16*** | (2006.01) |
| ***A45F 5/10*** | (2006.01) |

(52) U.S. Cl.

CPC ..... *A45C 1/04* (2013.01); *A45C 11/16* (2013.01); *A45C 13/02* (2013.01); *A45F 5/00* (2013.01); *A45F 2005/008* (2013.01); *A45F 2005/1013* (2013.01)

(58) Field of Classification Search

CPC .. A45C 1/04; A45C 1/06; A45C 11/16; A45C 11/18; A45C 11/182; A45C 13/02; A45F 5/00

USPC ..... 206/6.1; 224/165, 219

See application file for complete search history.

(56) References Cited

U.S. PATENT DOCUMENTS

| | | | | |
|---|---|---|---|---|
| 4,446,574 A * | 5/1984 | Kalomeris | A45C 1/04 | 2/247 |
| 4,462,116 A * | 7/1984 | Sanzone | A45C 1/04 | 2/160 |
| 4,723,657 A * | 2/1988 | Robinson | A45C 13/02 | 190/110 |
| 4,905,881 A * | 3/1990 | Graber | A45C 1/04 | 150/131 |
| 5,141,141 A * | 8/1992 | Leone | A41F 11/16 | 2/312 |

(Continued)

OTHER PUBLICATIONS

"Sale of Ring Bandit wrist band at least as early as Sep. 15, 2016 by Bandits."

*Primary Examiner* — Anthony D Stashick
*Assistant Examiner* — Raven Collins
(74) *Attorney, Agent, or Firm* — Nixon Peabody LLP

(57) ABSTRACT

Disclosed is a jewelry holder for holding engagement rings and other jewelry while the user is working out or doing other manual tasks with their hands. In some examples, the jewelry holder may be a wristband, ankleband, or hairband with a zipper pocket for safely enclosing a ring while performing physical activity that requires the hands. The holder may be made of a double sided material that includes a soft side that lines the inside of the pocket to prevent scratching to the jewelry. In some examples, the holder may be a wristband made from two pieces of fabric stitched together.

3 Claims, 14 Drawing Sheets

(56) References Cited

U.S. PATENT DOCUMENTS

| | | | | | |
|---|---|---|---|---|---|
| D373,900 | S * | 9/1996 | Montgomery, Sr. | D3/226 | |
| 5,671,481 | A * | 9/1997 | Giard | A41D 20/00 | 2/170 |
| 6,311,336 | B1 * | 11/2001 | Gootrad | A41D 27/208 | 2/251 |
| 6,443,341 | B1 * | 9/2002 | Rittmann | A45C 1/04 | 150/149 |
| 7,393,336 | B2 * | 7/2008 | Sloot | A61F 5/0104 | 602/60 |
| 8,381,989 | B2 * | 2/2013 | O'Neill | A44C 5/0015 | 235/487 |
| 9,386,815 | B2 * | 7/2016 | Miller | A41D 19/0024 | |
| 2006/0261108 | A1 * | 11/2006 | Watts, Sr. | A45C 13/30 | 224/222 |
| 2007/0057003 | A1 * | 3/2007 | Keyes | A41F 9/002 | 224/663 |
| 2007/0136946 | A1 * | 6/2007 | Haislip | A47G 9/086 | 5/413 R |
| 2008/0125688 | A1 * | 5/2008 | Kellogg | A61F 13/08 | 602/61 |
| 2008/0178977 | A1 * | 7/2008 | Nauman | A45C 1/04 | 150/144 |
| 2010/0140308 | A1 * | 6/2010 | Wilson | A45C 1/04 | 224/165 |
| 2012/0255097 | A1 * | 10/2012 | Feuchs | A63B 21/4011 | 2/22 |
| 2013/0239299 | A1 * | 9/2013 | Carter-Cohen | A45F 5/00 | 2/300 |
| 2017/0164578 | A1 * | 6/2017 | Ashcraft | A01K 1/0606 | |

* cited by examiner

JEWELRY HOLDER

CROSS REFERENCE TO RELATED APPLICATIONS

This application claims priority to U.S. Provisional Application No. 62/400,794, filed Sep. 28, 2016, titled "Jewelry Holder," the contents of which are incorporated herein by reference.

FIELD

The present invention is directed to accessories that may be worn around the wrist, ankle or as a hairband to carry jewelry.

BACKGROUND

The following description includes information that may be useful in understanding the present invention. It is not an admission that any of the information provided herein is prior art or relevant to the presently claimed invention, or that any publication specifically or implicitly referenced is prior art.

When people workout or perform other physical activities that require working with their hands, they typically remove their rings or other jewelry so they do not get scuffed or damaged. However, this requires setting a ring in a locker, pocket, or somewhere else that it may slip out or be stolen. Accordingly, many people leave their rings on and get them scratched or damages as there is no way to safely store their rings.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

Figure 1B:
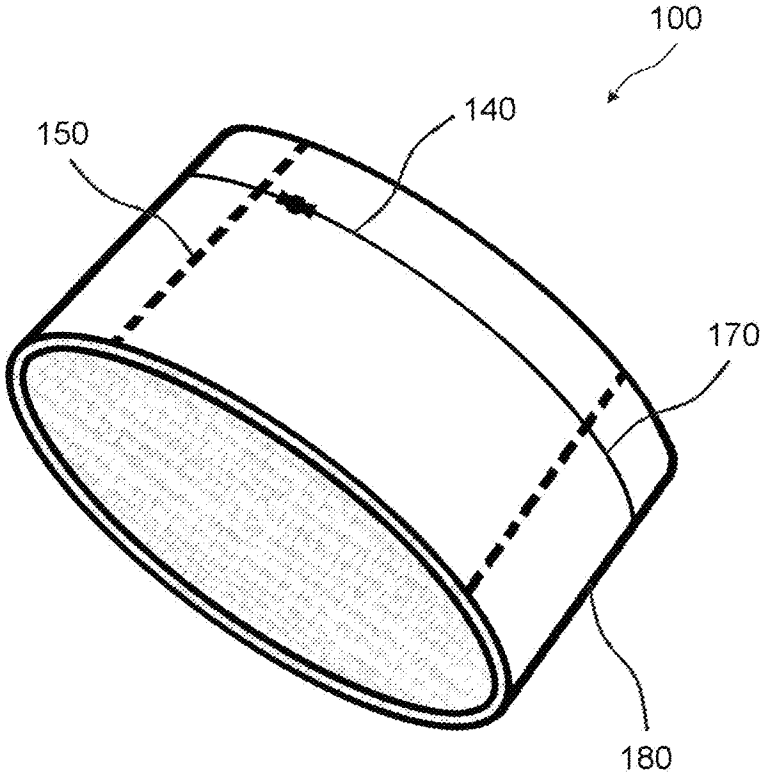
FIG. 1B depicts an example of a perspective view of a jewelry holder.

In the drawings, the same reference numbers and any acronyms identify elements or acts with the same or similar structure or functionality for ease of understanding and convenience. To easily identify the discussion of any particular element or act, the most significant digit or digits in a reference number refer to the Figure number in which that element is first introduced.

DETAILED DESCRIPTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly while operations may be depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Overview

Disclosed is a jewelry holder for holding engagement rings and other jewelry while the user is working out or doing other manual tasks with their hands. In some examples, the jewelry holder may be a wristband or hairband with a zipper pocket for safely enclosing a ring while performing physical activity that requires the hands. The holder may be made of a double sided material or a material with two layers that includes a soft or moisture protectant (e.g. gortex, or other water resistant layers) side that lines the inside of the pocket to prevent scratching to the jewelry or introducing moisture to the jewelry. In some examples, the holder may be a wristband made from two pieces of double side fabric stitched together to allow for a simplified method of manufacturing the accessory.

Figure 1A:
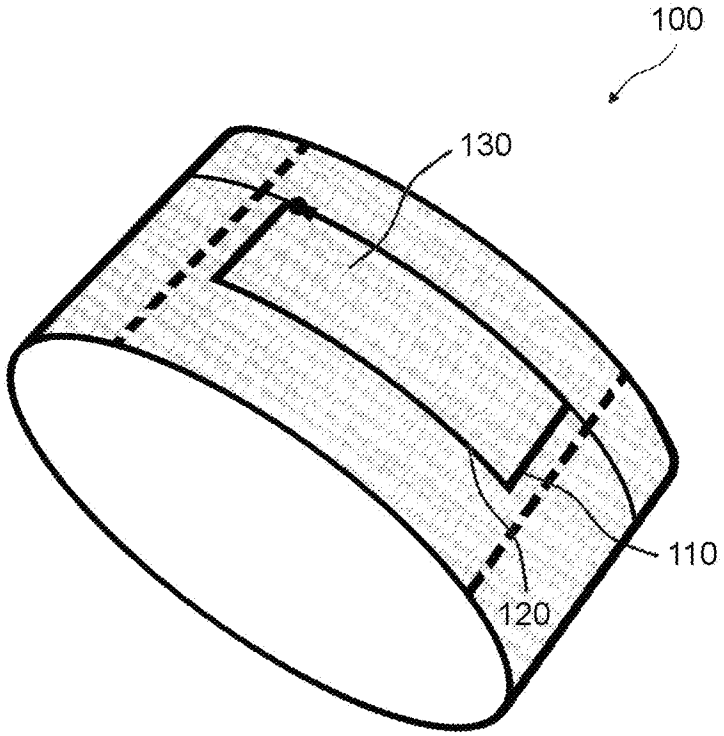
FIG. 1A depicts an example of a perspective view of a jewelry holder showing an inside pocket.

FIGS. 1A-1B are perspective views of an example of the disclosed jewelry holder 100. FIG. 1B illustrates an outside perspective view of a jewelry holder 100 with the zipper pull 140 closing the zipper 130 compartment, the stitch lines 150 that define the inside pocket 190 (as illustrated in FIG. 1A), the seam 170 between the two pieces of fabric and rim seam 160 of the fabric. In some examples, the fabric will form a complete cuff 180 as it will be stitched together in a suitable size to wear around the wrist, hair, or ankle. The pocket 190 may be fabricated by stitching the two layers of fabric together around the zipper 130 compartment to make variable sizes of pockets 190.

In some examples, a flap 110 will be attached (e.g. stitched) to the inside of the pocket 190 so that it covers the zipper to protect any jewelry inside the pocket 190 from the zipper. In some examples, the flap 110 will have a loose end 120 so that a piece of jewelry may be inserted in the pocket 190 and then the flap covers the zipper 140.

Figure 2B:
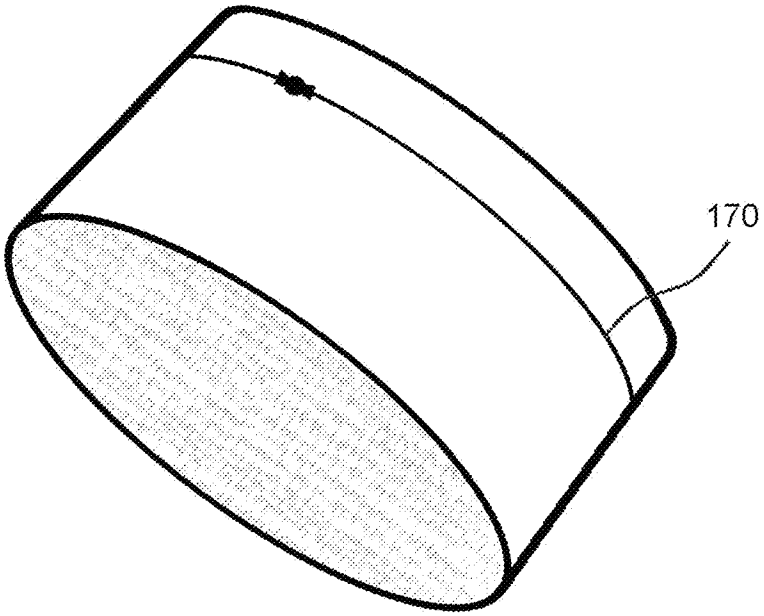
FIG. 2B depicts an example of a perspective view of a jewelry holder.
Figure 2A:
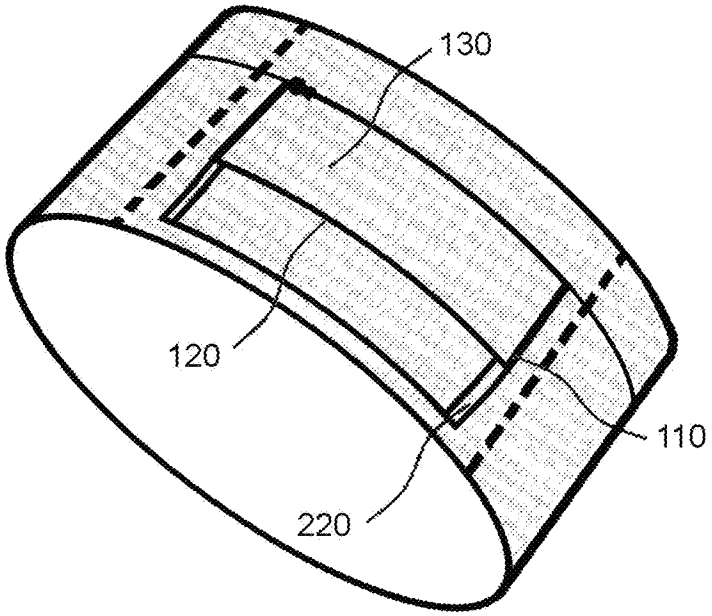
FIG. 2A depicts an example of a perspective view of a jewelry holder showing an inside pocket.
Figure 3B:
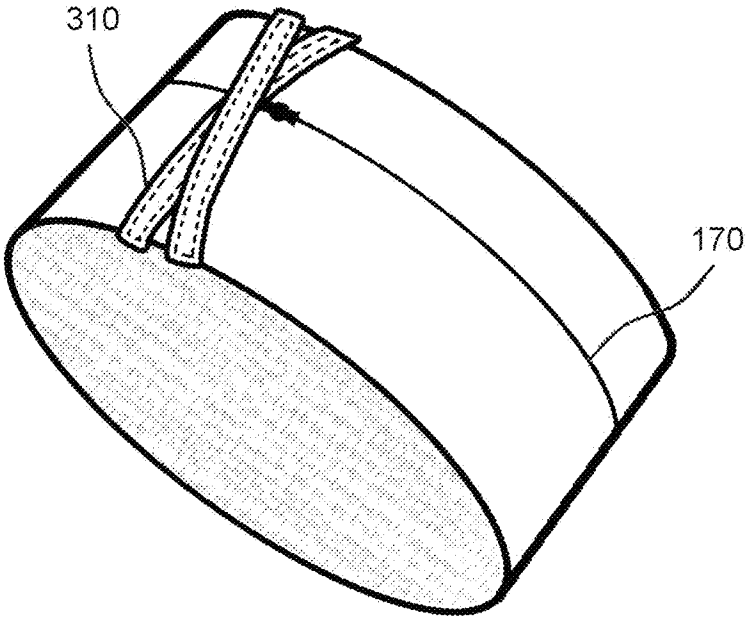
FIG. 3B depicts an example of a perspective view of a jewelry holder.
Figure 3A:
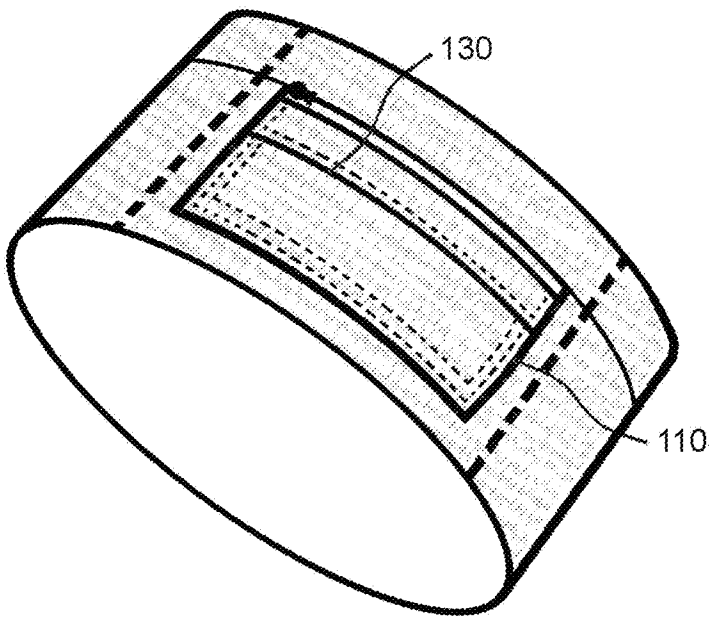
FIG. 3A depicts an example of a perspective view of a jewelry holder showing an inside pocket.

FIGS. 2A and 2B represent an example with a flap pocket 220 that is contained inside the two fabric layers of the jewelry holder 100. For instance, the flap 110 may attached to the jewelry holder by attaching to either the flap pocket 220, or the inside of the jewelry holder 100. In some examples, the pocket 220 may be made from two pieces of fabric stitched around the seam, or a single piece that is stitched near the opening of the zipper 130.

Figure 4B:
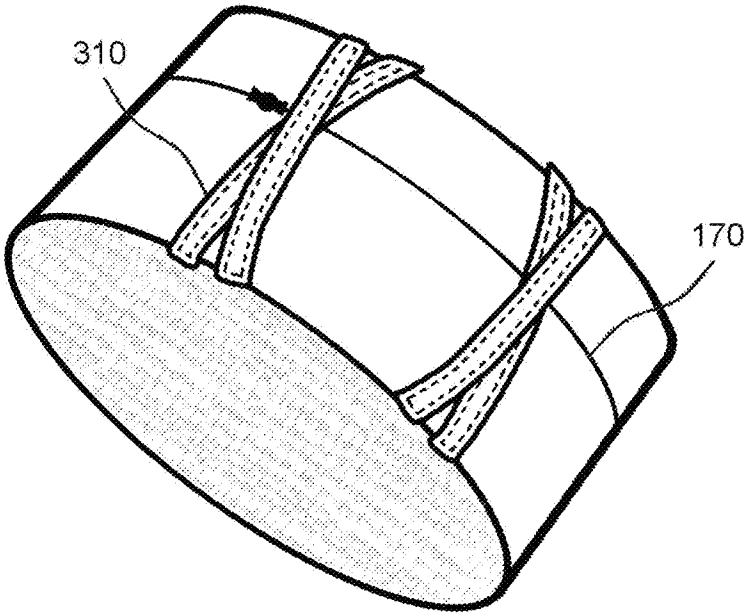
FIG. 4B depicts an example of a perspective view of a jewelry holder.
Figure 4A:
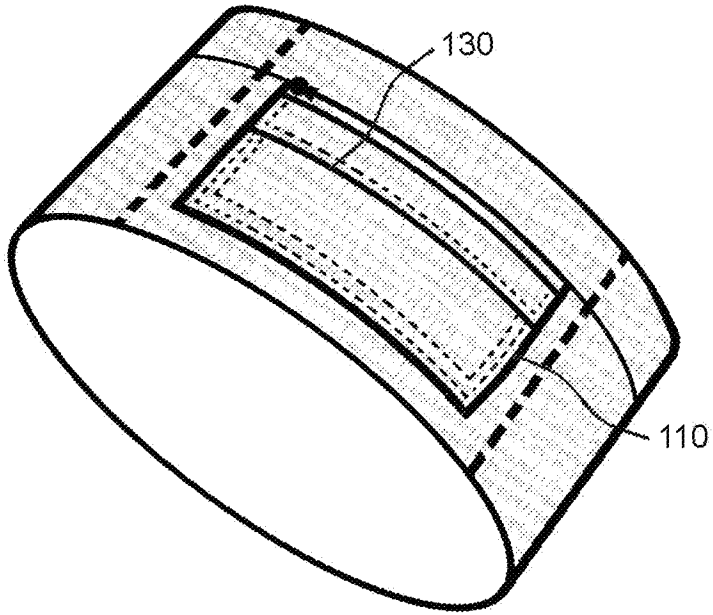
FIG. 4A depicts an example of a perspective view of a jewelry holder showing an inside pocket.

FIGS. 3A, 3B, 4A, 4B, 6A, and 6B represent another example that includes a flap pocket 220 that is inside the two fabric layers of the jewelry holder 100. Additionally, the outside includes straps 310 that can hide or retain zipper 130 or zipper pull 140 to prevent the zipper 130 from interfering with a workout or ruining the aesthetic look. Additionally, the straps 310 may provide extra security to retain zipper pull 140 in the closed position. FIG. 4B illustrates an additional example that includes straps 310 on the other side of the zipper 130 to balance the straps 130 over the zipper pull 140.

Figure 5B:
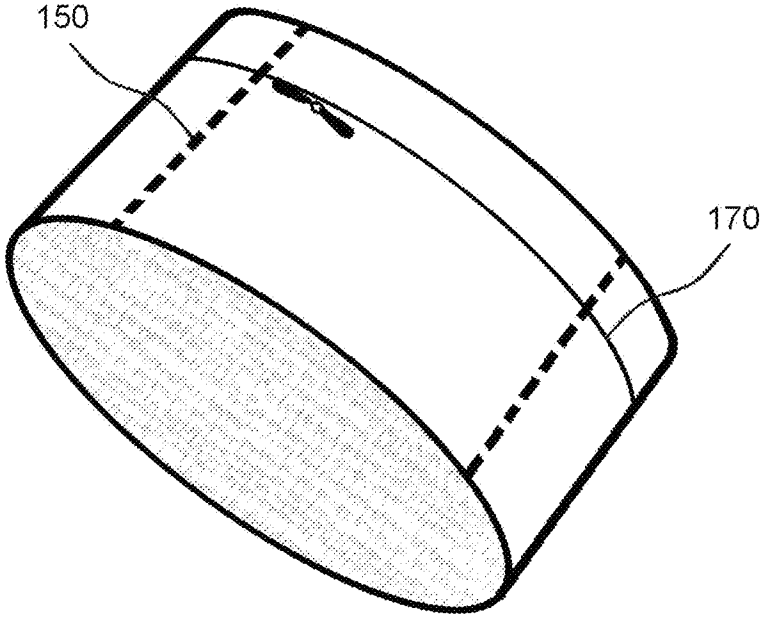
FIG. 5B depicts an example of a perspective view of a jewelry holder.
Figure 5A:
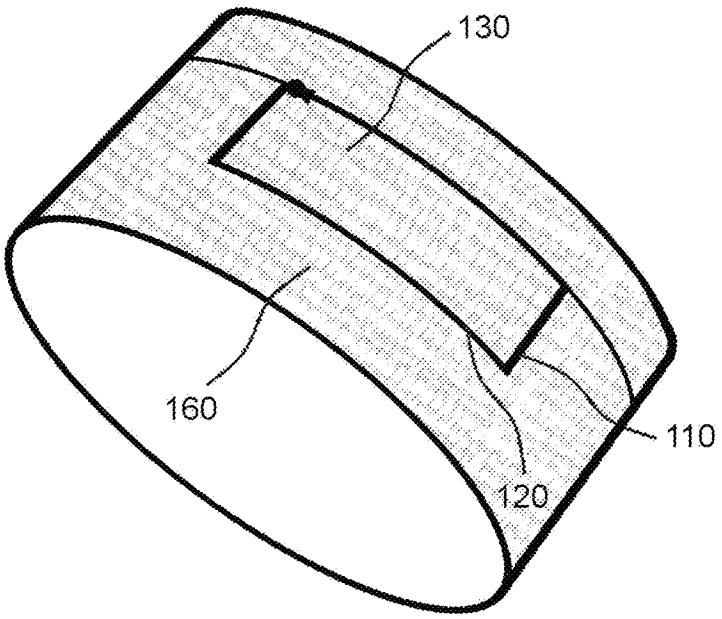
FIG. 5A depicts an example of a perspective view of a jewelry holder showing an inside pocket.
Figure 6B:
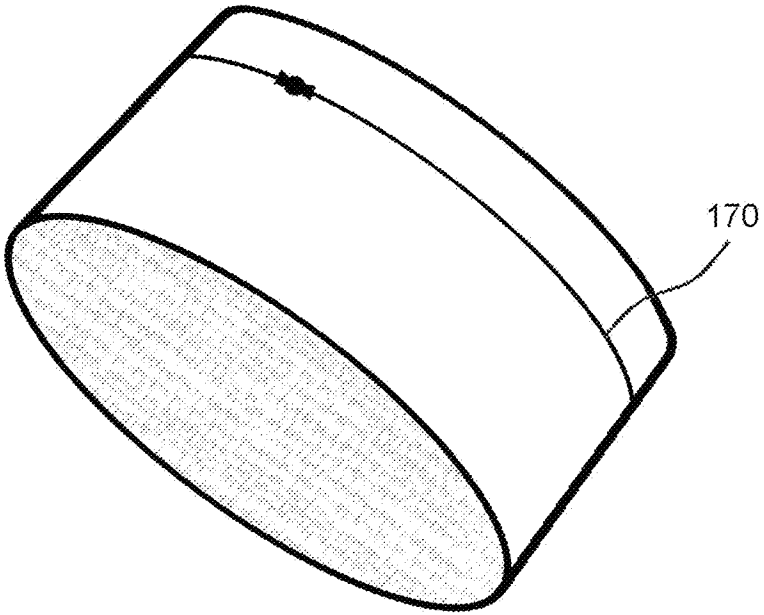
FIG. 6B depicts an example of a perspective view of a jewelry holder.
Figure 6A:
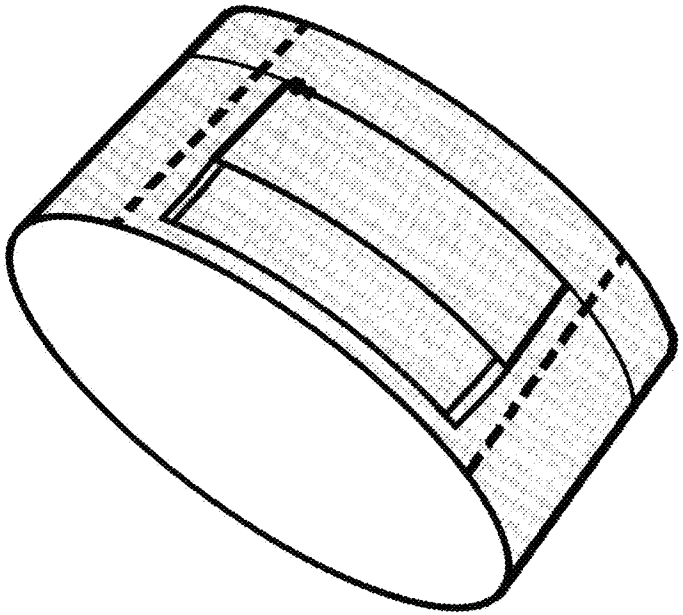
FIG. 6A depicts an example of a perspective view of a jewelry holder showing an inside pocket.

FIGS. 5A and 5B illustrate another example that does not include stitchlines on the inside portion as illustrated in FIG. 5A. In this example, the outside portion as stitchlines 150 that form a pocket with a piece of material between the two fabric layers that connects the stitchlines 140.

Figure 7:
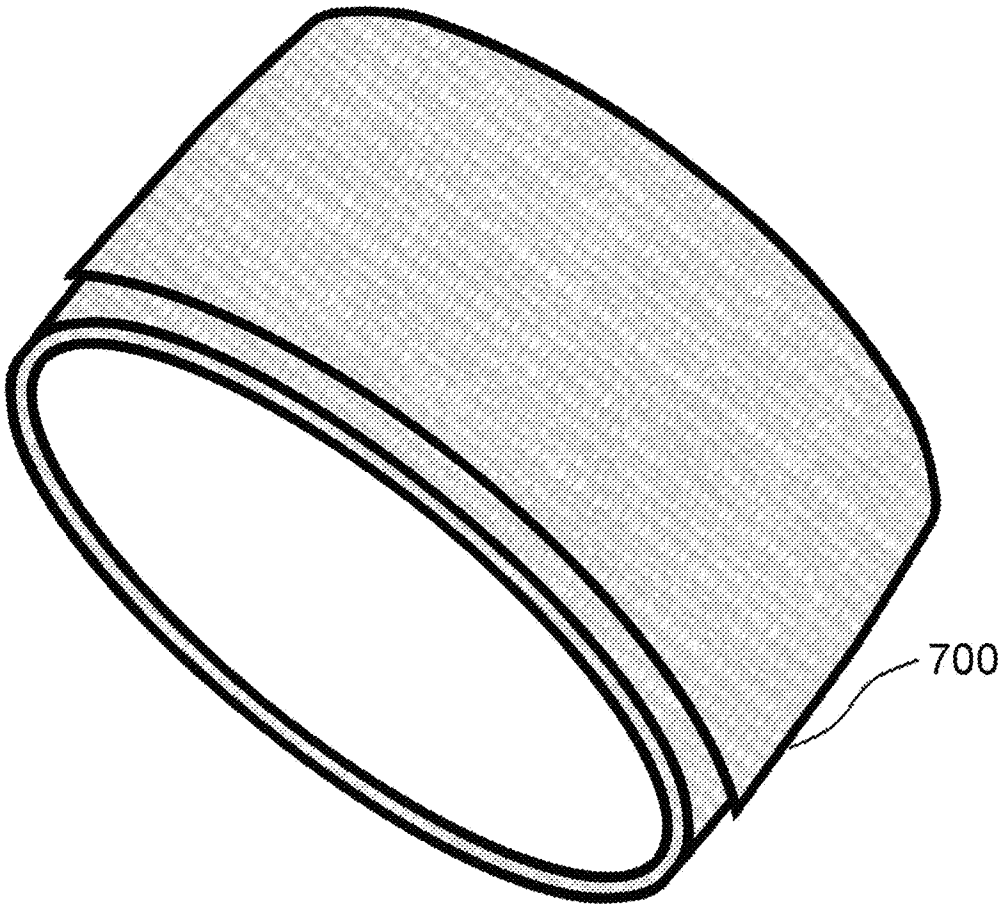
FIG. 7 depicts a perspective view of a jewelry holder with a flap.

FIG. 7 illustrates an example that includes a flap 700 that covers the entire zipper 130 portion for safety, to restrain the zipper pull 140 and for aesthetic purposes. Also, flap 700 may include an extra layer of cushion to protect jewelry inside the pocket 190.

Manufacturing

Figure 8:
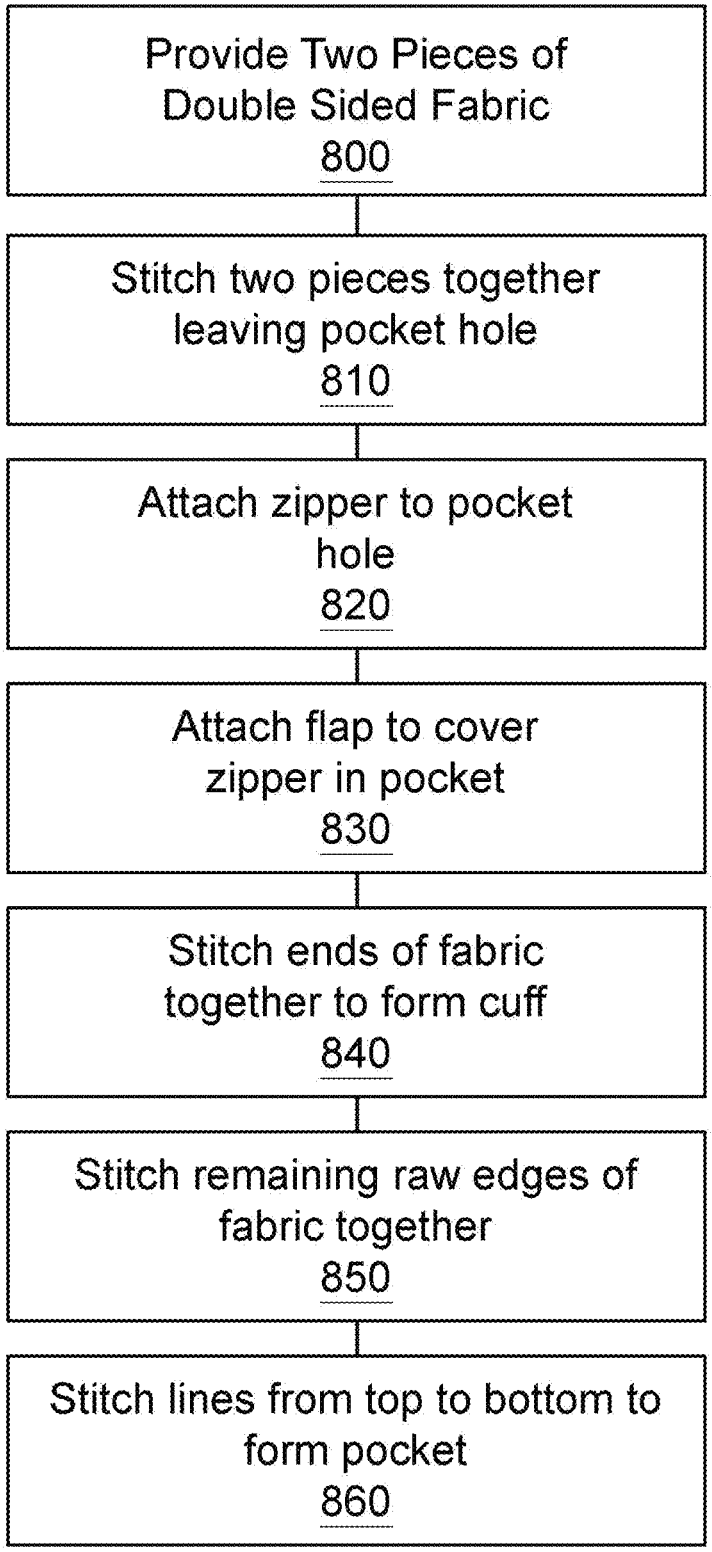
FIG. 8 depicts a flow chart illustrating a method of fabricating a jewelry holder.

FIG. 8 illustrates an example method of manufacturing a jewelry holder 100 according to the present disclosure. In some examples, a two sided fabric is provided 800. The two sided fabric may initially be provided in one, two, three, four or more pieces of double side fabric.

In some examples, the double sided fabric may include a softer side to protect the jewelry from scratching or wearing—as jewelry can be permanently damaged, scuffed, or even smudged by improper fabric contacting it. Additionally, in some examples the two layers of fabric prevent against moisture from penetrating the jewelry holder. In some examples, the fabric may be absorbent to avoid excess water, moisture or sweat from contacting the ring. In some examples, the jewelry holder may include a waterproof membrane for preventing moisture from contacting the jewelry.

For instance, the fabric may be 752 Chine Soft available from Carvico, felt, or other soft materials. The fabric may be 87% polyamide and 13% elastane or other suitable compositions. However, one side of the fabric may be softer, or provide other surfaces that avoid scratching the jewelry. In some examples, the fabric may be elastic so that the user can easily slide on the jewelry holder 100 so that it fits tightly around the wrist and secures the jewelry in place during hand movements. In some examples, one side of the fabric is brushed to provide a softer side for the jewelry.

Next, in some examples, two pieces of the fabric will be stitched together while leaving a hole for the pocket 810. In other examples, a whole will be cut in one piece of fabric instead of stitching two pieces together. Then, the zipper 130 may be attached to the pocket hole 820. The zipper 130 may be a plastic, metal, Ziploc style plastic zipper 130 or other suitable zippers. Then, in some examples, the flap may be attached to cover the zipper in the pocket 830. In other examples, the jewelry holder 100 may not include a flap 110. In other examples, snaps or clips may be used instead of a zipper 130.

Then, the ends of the fabric may be stitched together to form a cuff or bracelet 840. This may be performed, so that a softer or absorbent side remains facing the inside of the jewelry holder. In other examples, the seams may be welded together or other suitable methods may be utilized for attaching them. In some examples, this will allow a cuff to be formed that is elastic so the user may stretch it out to slide it over their wrist. Then, the top portion may be folded over to form a double layer.

Then, in some examples the remaining raw edges may be sewn or stitched together 850. This may be performed by pulling the raw edges through the zipper 130 opening. Then, in some examples, a pocket may be formed by stitching lines from top to bottom 860 to form a pocket by stitching the two layers of fabric together. In other examples, the stitch lines may be only a portion of the cuff to make a desired size of pocket 190. For instance, a ring sized pocket 190 may be stitched around the zipper 130.

Figure 9A:
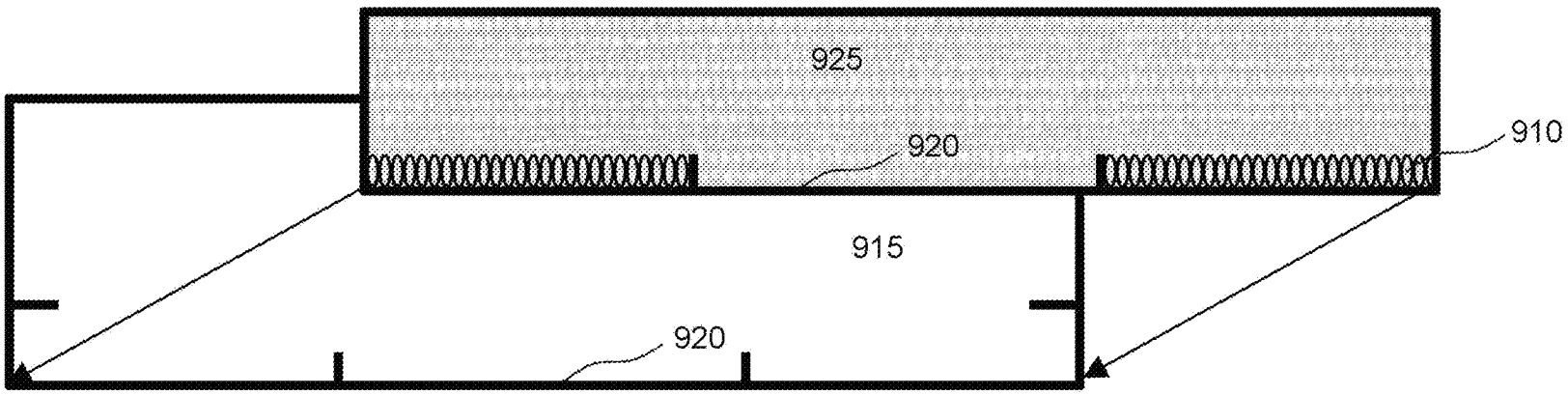
FIG. 9A depicts a schematic view of a method of attaching two pieces of double sided fabric together.
Figure 9B:
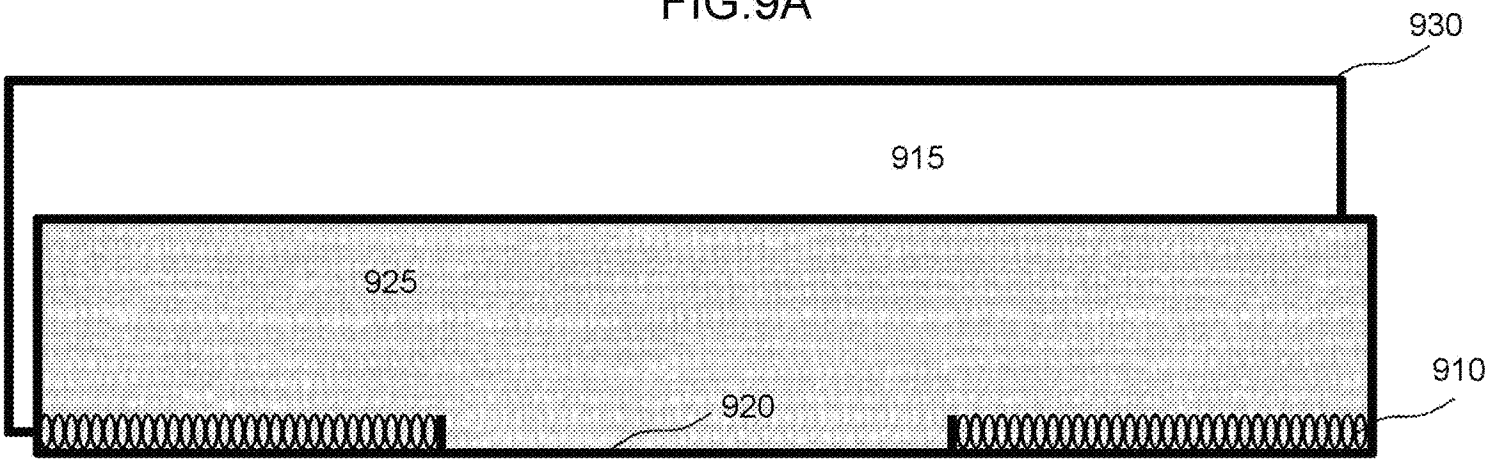
FIG. 9B depicts a schematic view of a method of attaching two pieces of double sided fabric together.

FIGS. 9A and 9B illustrate a step of stitching two pieces of fabric together 810. As illustrated, a stitch line 910 may be formed except for the zipper opening 920. As illustrated, the fabric has a soft side 925 or jewelry side 925 and an outer side 915. Also illustrated is the raw edge 930 of the fabric.

Figure 10A:
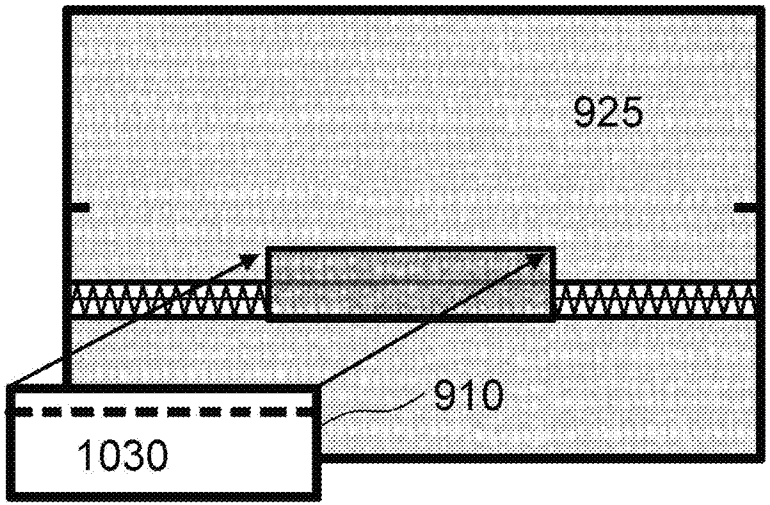
FIG. 10A depicts a top view of two pieces of fabric stitched together with a zipper attached.
Figure 10B:
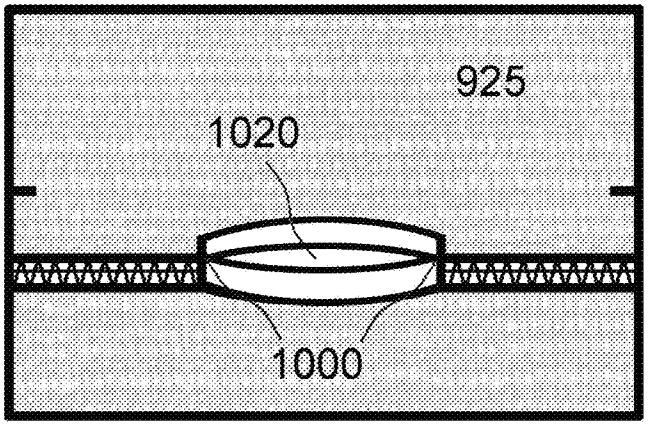
FIG. 10B depicts a top view with a flap of fabric being attached over a zipper.

FIG. 10A illustrates attachment of the zipper 1000 to form the zipper opening 1020. The zipper opening 1020 may be large enough to fit a ring or other jewelry. FIG. 10B illustrates attachment of a flap 1030 to the fabric with stitchline 1030 to the fabric pieces. The flap 1030 may be attached proximate the zipper 130. In other examples, the flap 1030 could be attached to different portions or in different manners.

Figure 11:
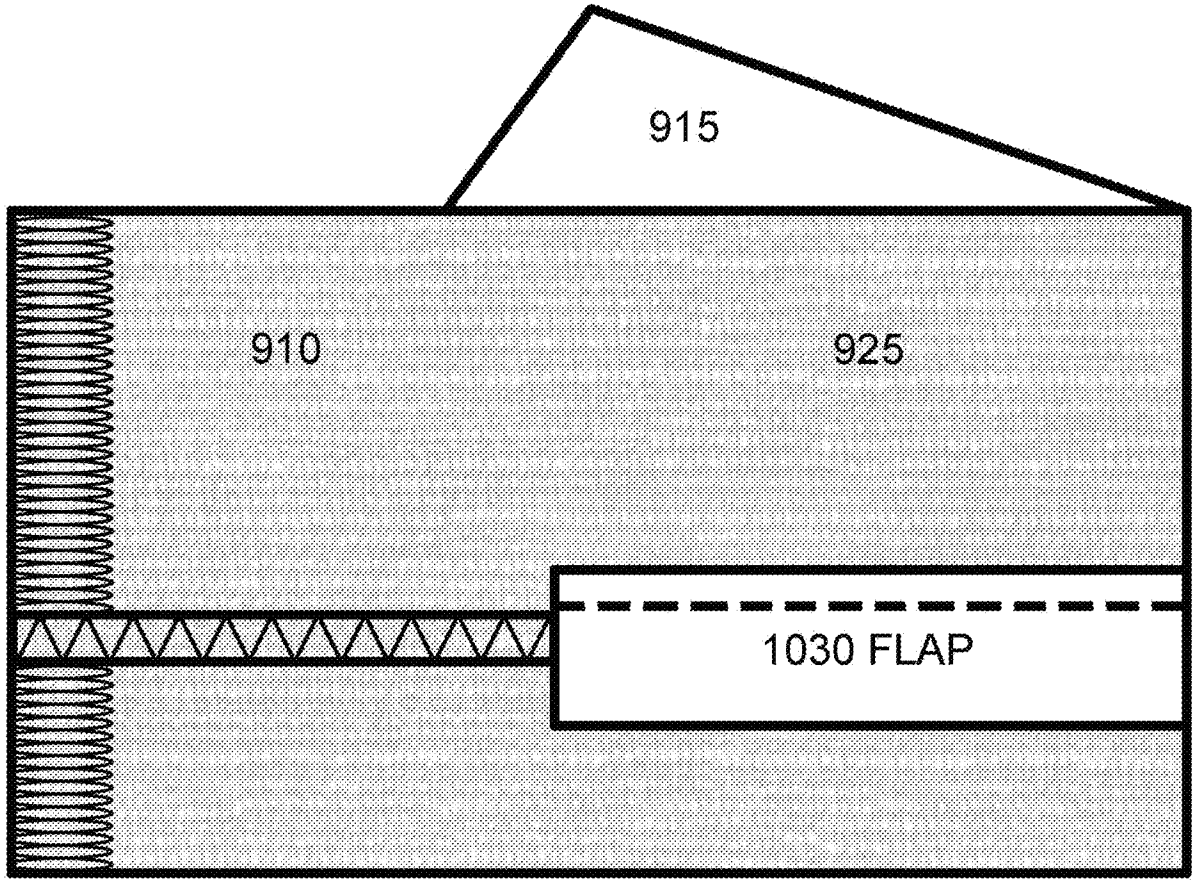
FIG. 11 depicts a view of two ends of the fabric being stitched together to form a bracelet.

FIG. 11 illustrates folding of the fabric in half to stitch it together to form a cuff along the stitchline 910. In this example, the fabric is folded in half lengthwise and then stitched together. After this step, fabric is folded down so that the soft or jewelry side 925 is on the inside and the jewelry holder 100 will form a double layer cuff.

Figure 12B:
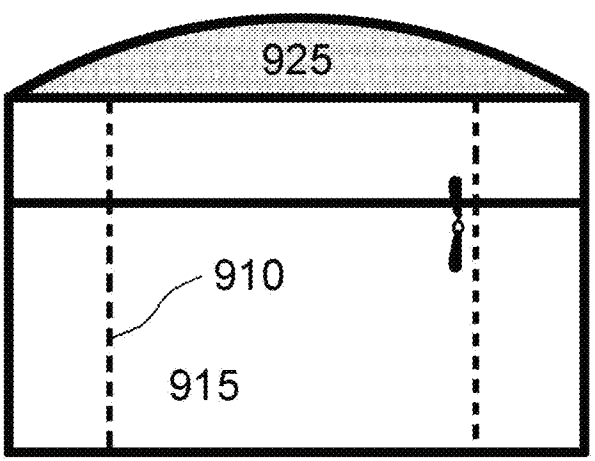
FIG. 12B depicts a perspective view of stitching pocket seams from top to bottom.
Figure 12A:
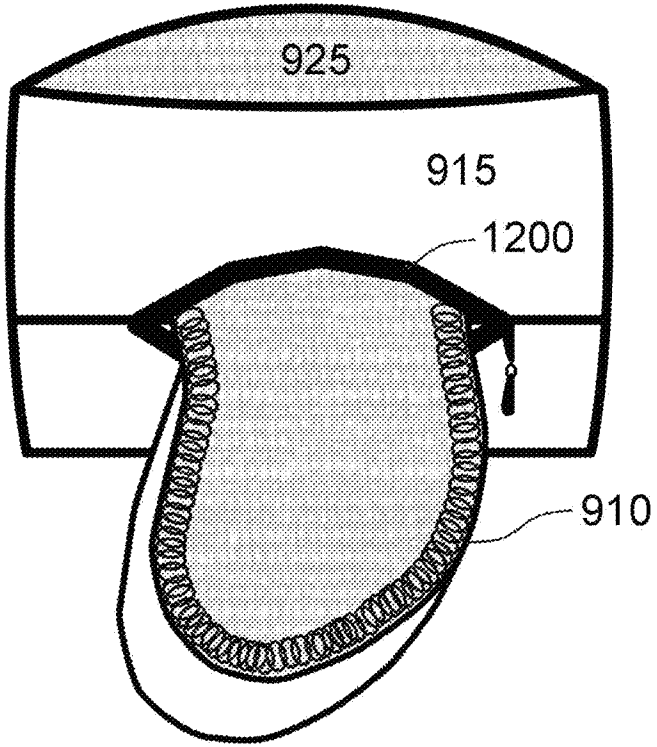
FIG. 12A depicts a perspective view of stitching edges together through the zipper hole.
Figure 13:
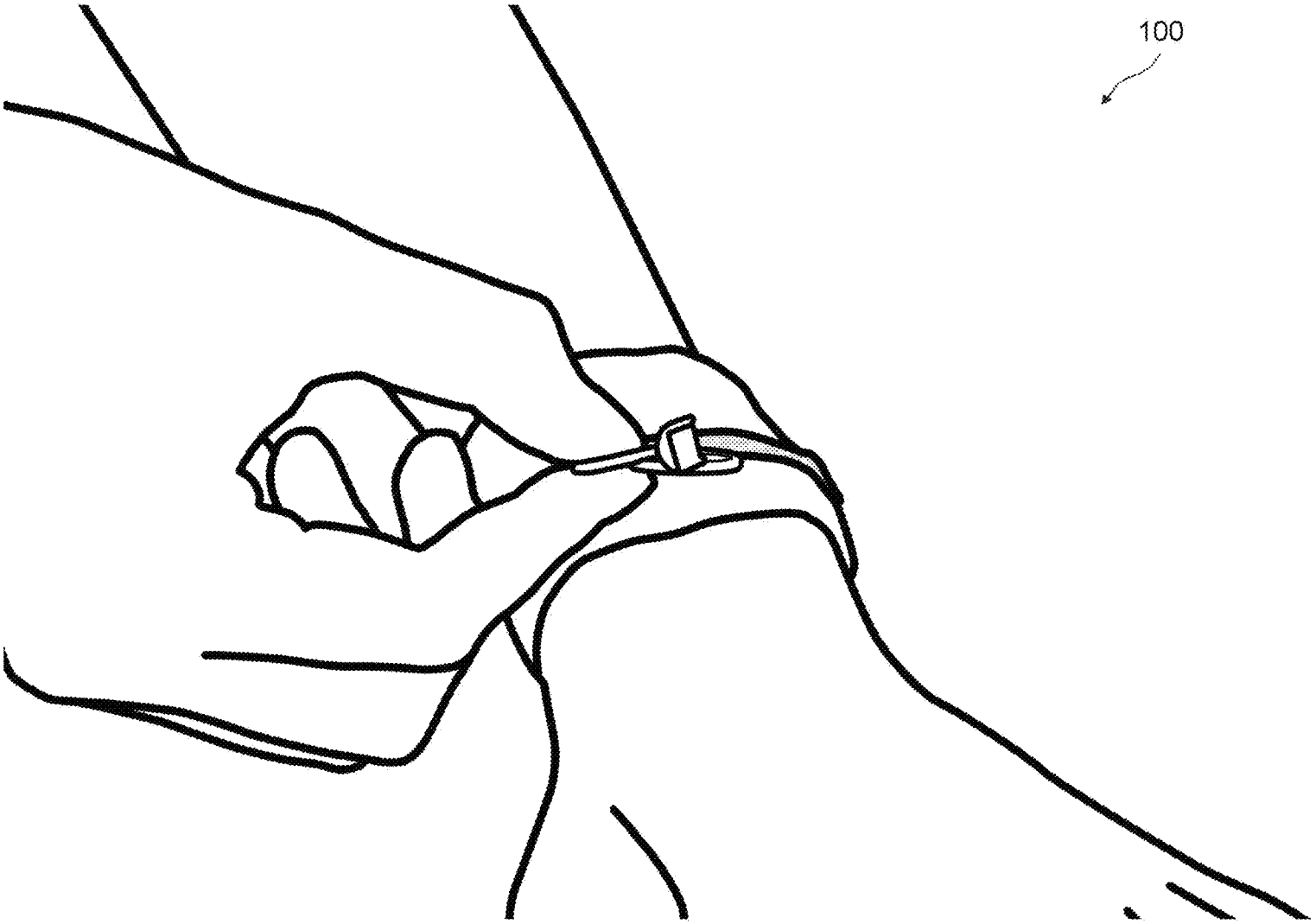
FIG. 13 depicts a perspective view of a jewelry holder being closed by a user.
Figure 14:
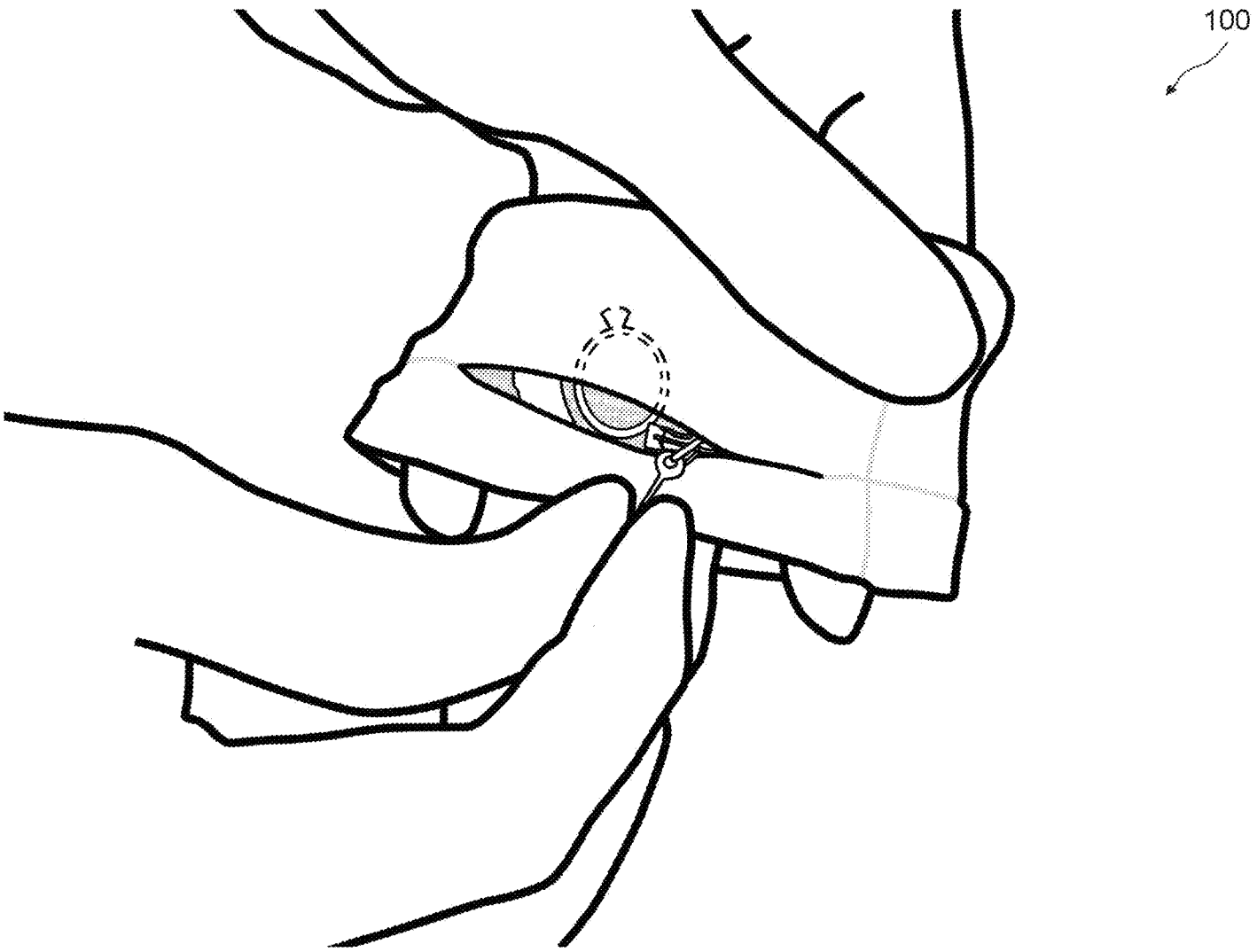
FIG. 14 depicts a perspective view of a ring being inserted in a jewelry holder by a user.

FIG. 12A illustrates stitching the remaining portions of the fabric that are loose together with stitchline 910. In some examples, this may be performed by pulling the fabric through the zipper opening 1020. In other examples, the stitching may be performed from the outside. FIG. 12B illustrates stitchlines 910 added to the jewelry holder 100 to form the pocket 190 by attaching the two layers of the fabric together.

Accordingly, the pocket 190 is now ready to receive jewelry and protect it with the soft side of the double sided fabric.

CONCLUSION

The various methods and techniques described above provide a number of ways to carry out the invention. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some embodiments specifically include one, another, or several features, while others specifically exclude one, another, or several features, while still others mitigate a particular feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be employed in various combinations by one of ordinary skill in this art to perform methods in accordance with the principles described herein. Among the various elements, features, and steps some will be specifically included and others specifically excluded in diverse embodiments.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

In some embodiments, the terms "a" and "an" and "the" and similar references used in the context of describing a particular embodiment of the application (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Certain embodiments of this application are described herein. Variations on those embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

Particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

All patents, patent applications, publications of patent applications, and other material, such as articles, books, specifications, publications, documents, things, and/or the like, referenced herein are hereby incorporated herein by this reference in their entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that can be employed can be within the scope of the application. Thus, by way of example, but not of limitation, alternative configurations of the embodiments of the application can be utilized in accordance with the teachings herein. Accordingly, embodiments of the present application are not limited to that precisely as shown and described.

The invention claimed is:

1. A method of manufacturing a jewelry holder, the method comprising:

providing two pieces of fabric having elastic properties;

stitching the two pieces of fabric together to form a two-layered cuff sized to fit a wrist using a first pair of parallel stitches, the cuff including an opening positioned between and in line with the first pair of parallel stitches;

subsequent to the stitching the two pieces of fabric together, attaching a zipper to the opening;

forming a pocket using a second pair of parallel stitches that are perpendicular to the first pair of parallel stitches and extend from a first end of the cuff to a second end of the cuff; and attaching a flap inside the pocket, the flap being configured to aid in inhibiting contact between jewelry stored in the pocket and the zipper.

2. The method of claim 1, wherein the zipper is plastic.

3. The method of claim 1, further comprising attaching at least one strap to a top and bottom rim of the cuff to retain a zipper pull.

* * * * *